US006106106A

United States Patent [19]

Nakazawa et al.

[11] Patent Number: 6,106,106

[45] Date of Patent: Aug. 22, 2000

[54] INK JET RECORDING HEAD HAVING A PIEZOELECTRIC SUBSTRATE

[75] Inventors: Toshiaki Nakazawa, Niigata; Takashi Ota; Koji Shigemura, both of Tokyo, all of Japan

[73] Assignee: NEC Corporation, Tokyo, Japan

[21] Appl. No.: 09/007,072

[22] Filed: Jan. 14, 1998

[30] Foreign Application Priority Data

Jan. 14, 1997 [JP] Japan ..... 9-004405
Jan. 21, 1997 [JP] Japan ..... 9-008465

[51] Int. Cl.[7] ..... B41J 2/045

[52] U.S. Cl. ..... 347/68

[58] Field of Search ..... 347/20, 54, 68, 347/72

[56] References Cited

U.S. PATENT DOCUMENTS 5,432,540 7/1995 Hiraishi ..... 347/69

FOREIGN PATENT DOCUMENTS 0 609 080 8/1994 European Pat. Off. .
0 653 303 5/1995 European Pat. Off. .
53-12138 4/1978 Japan .
61-59913 12/1986 Japan .
6-143564 5/1994 Japan .
7-232431 9/1995 Japan .
7-329290 12/1995 Japan .

*Primary Examiner*—Arthur T. Grimley
*Assistant Examiner*—Hoang Ngo
*Attorney, Agent, or Firm*—Foley & Lardner

[57] ABSTRACT

An ink jet recording head has a plurality of ink channels, disposed on a piezoelectric substrate, for receiving liquid ink therein, a plurality of dummy channels arranged alternately with the ink channels on the substrate, a top plate for covering the ink channels and dummy channels, and a nozzle plate defining the front end of the channels and having a nozzle for each of the ink channels for ink ejection. The dummy channels have a depth larger than the depth the ink channel, and the top plate has a slit extending along each of the dummy channels, for reducing cross-talks between adjacent ink channels.

9 Claims, 12 Drawing Sheets

Hd = 150μm

Hd = 200μm

Hd = 300μm

Hd = 400μm

INK JET RECORDING HEAD HAVING A PIEZOELECTRIC SUBSTRATE

BACKGROUND OF THE INVENTION (a) Field of the Invention

The present invention relates to an ink jet recording head having a piezoelectric substrate and, more particularly, to an ink jet recording head of piezoelectric type suitable for use in a printer, facsimile, copying machine etc. The present invention also relates to a method for manufacturing such an ink jet recording head.

(b) Description of the Related Art

Ink jet recording heads are classified in two categories based on the principle of the ink ejection. The first category is called a thermal ink jet type or a bubble jet type described in Patent Publication No. JP-B-61(1986) -59913, for example. The described ink jet recording head comprises a thermal head on which a plurality of thermal elements is arranged, and a pressure chamber having an ink nozzle disposed to each of the thermal elements for ejecting liquid ink. In operation, the thermal elements are energized to heat the liquid ink thereon for generating bubbles, the pressure of which ejects the liquid ink from the ink nozzles.

The first type has the advantage in that a thermal head can be fabricated having a large number of nozzles arranged in a high density by using a photolithographic technique. However, it has also the disadvantage in that some ingredients in the liquid ink heated up to above 300° C. for generation of bubbles are likely to be deposited on the thermal elements after some continuous ejection period to cause a malfunction. Moreover, the thermal stress or cavitation generated by the heated ink may cause damages in the thermal elements or cause a pinhole in the protective film for the thermal elements, which reduces the lifetime of the ink jet recording head.

The second category is called a piezoelectric type described in Patent Publication No. JP-B-53(1978)-12138, for example. This type of ink jet recording head comprises a pressure chamber formed by a piezoelectric element which receives liquid ink therein and is communicated to ink nozzles and an ink supply tube. The piezoelectric element is energized during operation for controlling the volume of the pressure chamber to eject the liquid ink from the nozzles.

The second type has the advantages in that a variety of liquid inks can be used in the recording head and has a long lifetime. However, it has the disadvantage in that it is difficult to arrange a large number of piezoelectric elements in a high density to achieve a high density recording.

Patent Publication No. JP-A-6(1994)-143564 proposes a high density ink jet recording head of the piezoelectric type. Referring to FIG. 1, the proposed head comprises a piezoelectric planar substrate 40, a top plate 44, and a plurality of ink channels 41*bc*, 41*de*, . . . and a plurality of dummy channels 42*ab*, 42*cd*, . . . which are alternately arranged on the main surface of the planar substrate 40 and covered by the top plate 44. Before operation, liquid ink is filled only in the ink channels 41*bc*, 41*de*, . . . . In addition, the walls 43*b*, 43*c*, 43*d*, 43*e*, . . . of the piezoelectric substrate 40 separating the channels are polarized beforehand by using electrodes 48*bc*, 48*cd*, 48*de*, . . . formed on the surfaces of the respective channels, in the direction of arrows 47, each of which is directed from a dummy channel to an adjacent ink channel.

In operation, a driving pulse is applied to a specified channel (or to the electrode of a specified channel, more accurately), while the dummy channels are maintained at a ground potential, to expand the side walls of the specified channel, which changes the volume of the specified channel for ejection of the liquid ink therefrom as an ink droplet.

The proposed ink jet recording head mentioned above has a problem in generation of cross-talk, wherein the speed and the size of the ink droplet differ depending on the number of ink channels concurrently driven by a driving pulse.

SUMMARY OF THE INVENTION

It is therefore an object of the present invention to provide an ink jet recording head of a piezoelectric type capable of reducing cross-talk between channels and providing a stable ink droplet for an excellent image quality.

It is another object of the present invention to provide a method for manufacturing such an ink jet recording head.

The present invention provides, in a first aspect thereof, an ink jet recording head comprising a piezoelectric substrate having a plurality of ink channels for receiving liquid ink therein and a plurality of dummy channels extending parallel to one another and to the ink channels on a main surface of the substrate, the ink channels and the dummy channels being arranged alternately on the piezoelectric substrate, a plurality of separate electrodes disposed in the respective ink channels, a common electrode disposed in the dummy channels, a top plate disposed on the main surface of the piezoelectric substrate for covering the ink channels and the dummy channels, a nozzle plate disposed at a front surface of the piezoelectric substrate for defining front ends of the channels and having a nozzle for each of the ink channels for ejection of liquid ink therefrom, the dummy channels having a depth larger than a depth of the ink channels.

The present invention also provides, in a second aspect thereof, an ink jet recording head comprising a piezoelectric substrate having a plurality of ink channels for receiving therein liquid ink and a plurality of dummy channels extending parallel to one another and to the ink channels on a main surface of the piezoelectric substrate, the ink channels and the dummy channels being arranged alternately on the piezoelectric substrate, a plurality of separate electrodes disposed in the respective ink channels, a common electrode disposed in the dummy channels, a top plate disposed on the main surface of the piezoelectric substrate for covering the ink channels and the dummy channels, a nozzle plate disposed at a front surface of the substrate and having a nozzle for each of the ink channels for ejection of liquid ink therefrom, the top plate having a slit corresponding to each of the dummy channels.

In view of the problem cross-talk in the ink jet recording head, the inventors noted that the following two points are the causes of the problem:

(1) application of a driving pulse to the specified ink channel generates a transformation of a portion of the top plate right above the specified channel, which in turn causes a transformation of the side walls of the adjacent ink channels due to the rigidity of the top plate; and (2) the transformation of the side wall of the specified ink channel is constrained by the bottom of the specified channel, which generates a transformation of the side walls of the adjacent ink channels through the bottom of the adjacent dummy channels.

The ink jet recording head of the present invention decreases the transformation transferred either by the top plate or the bottoms of the dummy channels, thereby decreasing the cross-talk between the adjacent ink channels during driving a specified ink channel.

The above and other objects, features and advantages of the present invention will be more apparent from the following description, referring to the accompanying drawings.

PREFERRED EMBODIMENTS OF THE INVENTION

Figure 1:
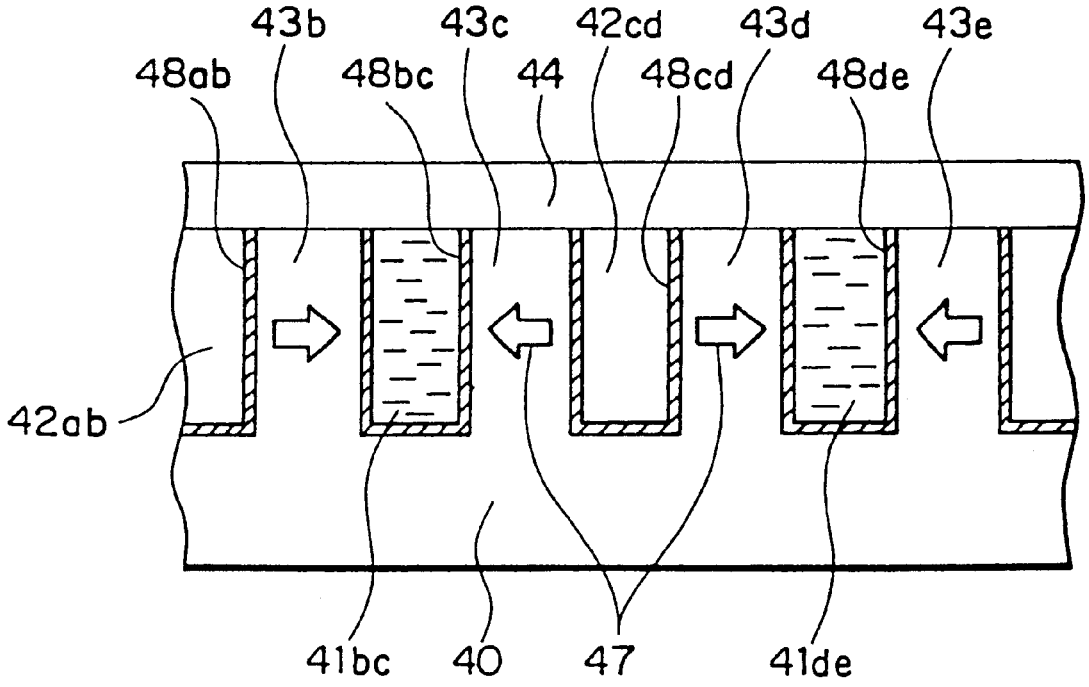
FIG. 1 PRIOR ART
FIG. 1 is a cross-sectional view of a conventional ink jet recording head of a piezoelectric type.

Now, the present invention is more specifically described with reference to accompanying drawings, wherein similar constituent elements are designated by the same or similar reference characters or numerals.

Figure 2:
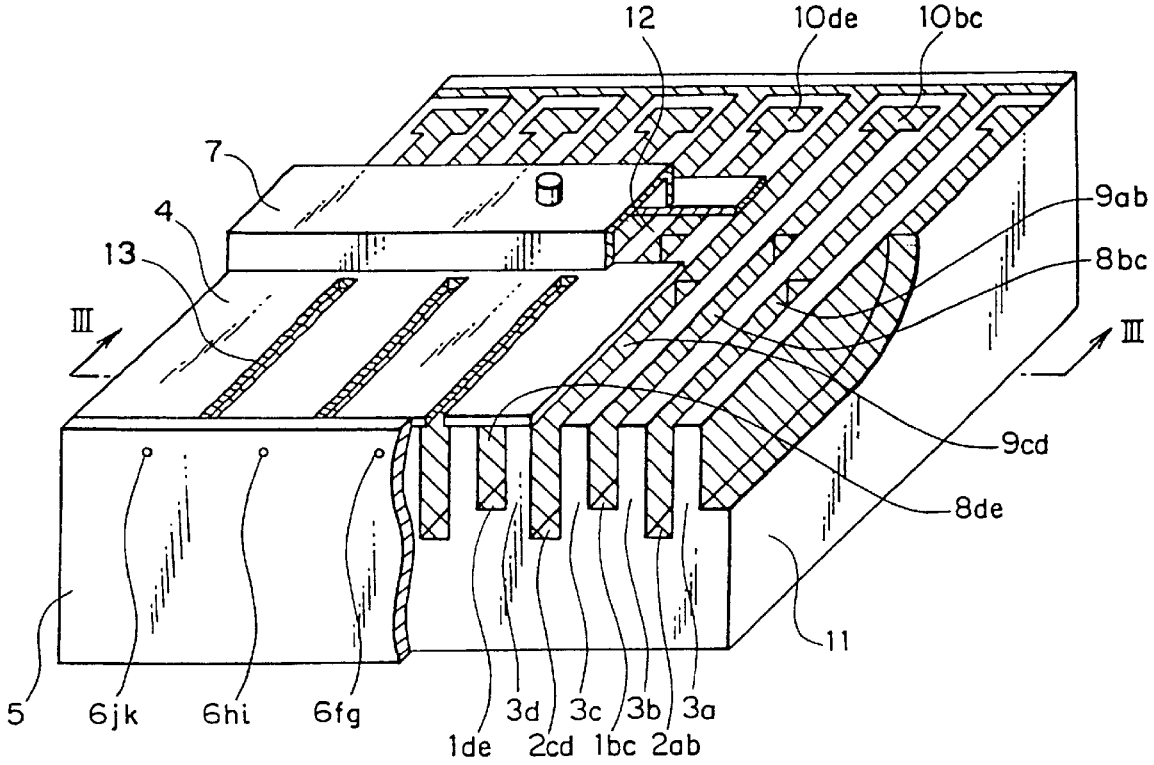
FIG. 2 is a perspective view of an ink jet recording head according to a first embodiment of the present invention.

Referring to FIG. 2 showing an ink jet recording head according to a first embodiment of the present invention, ink channels 1*bc*, 1*de*, . . . and dummy channels 2*ab*, 2*cd*, . . . are arranged alternately with each other on a main surface of a piezoelectric substrate 11, with the piezoelectric side walls 3*a*, 3*b*, . . . disposed therebetween. A top plate 4 made of a resilient material and having a slit above each dummy channel is disposed on the main surface of the piezoelectric substrate 11 to cover the ink channels, whereas a nozzle plate 5 having a nozzle 6*fg*, 6*hd*, 6*ik*, . . . for each ink channel 1*bc*, 1*de*, . . . is disposed at the front surface of the substrate 11 to define the longitudinal end of each of the channels. At the intermediate portion of the ink channels, as viewed along the channels, a U-shaped trough 7 is provided on the top plate for defining a common ink pool between the trough 7 and the substrate 11 for supplying liquid ink to each ink channel. The ink is introduced to the ink pool through an ink inlet port of the trough 7 by a pump not shown. The ink channels 1*bc*, 1*de*, . . . have a length larger than the length of the dummy channels 2*ab*, 2*cd*, . . . . Each of the ink channels has a curvature at the rear end of the channel as clearly shown by the specific ink channel disposed at the right end of the recording head, as viewed in FIG. 2. The ink channels receive liquid ink from the ink pool at the rear end thereof. The front surface of the substrate 11 is covered by a front plate or nozzle plate 5 having a nozzle for each of the ink channels.

The ink channel 1*bc*, 1*de*, . . . have on the inner surfaces thereof respective separate electrodes 8*bc*, 8*de*, . . . , which are connected to respective pads 10*bc*, 10*de*, . . . , whereas the dummy channels 2*ab*, 2*cd*, . . . have respective branches of a common electrode 9*ab*, 9*cd*, . . . disposed on the inner surfaces thereof. The separate electrodes and the branches of the common electrode extend from the front end of the respective channels toward the rear end of the substrate, where the branches of the common electrode are connected together by a bridge portion.

Figure 3:
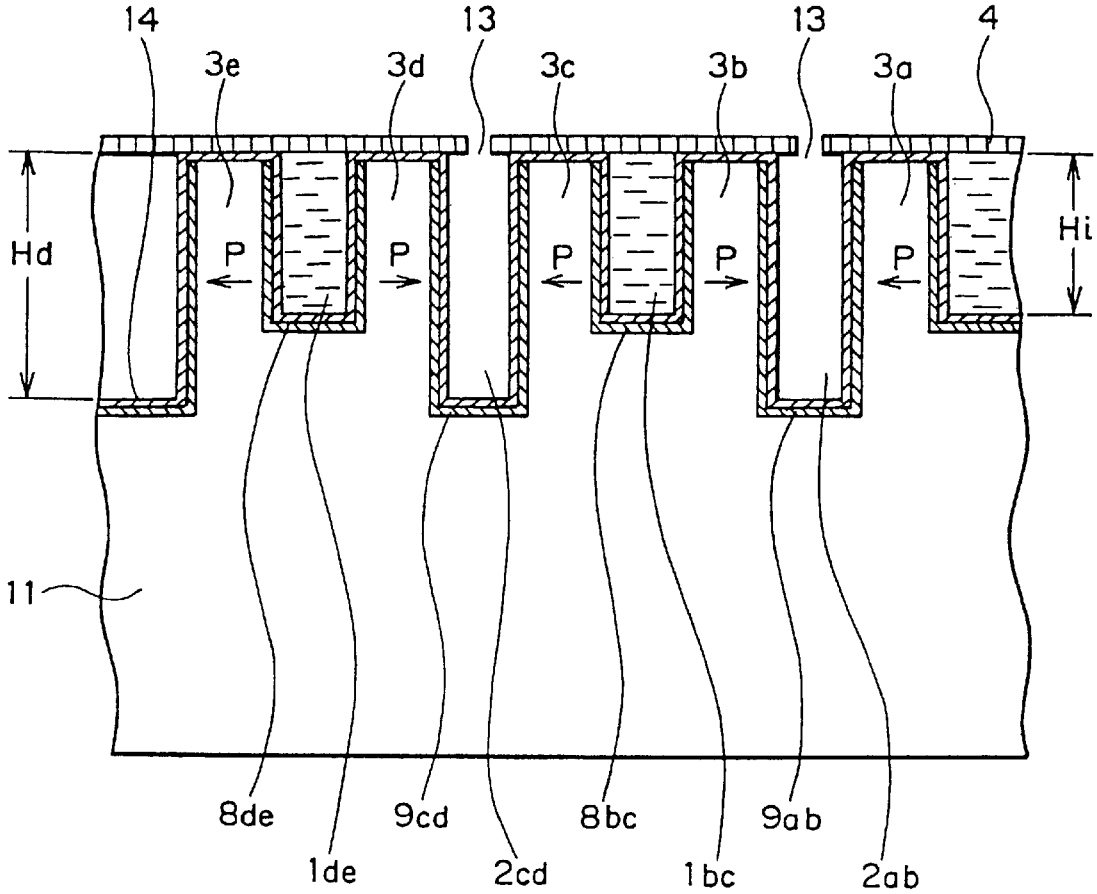
FIG. 3 is a cross-sectional view of the ink jet recording head of FIG. 2 taken along line III—III.

Referring to FIG. 3 showing a cross-section of the ink jet recording head of FIG. 2 taken along line III—III, a piezoelectric side wall 3*a*, 3*b*, 3*c*, . . . is disposed between each of the ink channels 1*bc*, 1*de*, . . . and the adjacent dummy channels 2*ab*, 2*cd*, . . . . Liquid ink is introduced only in the ink channels 1*bc*, 1*de*, . . . .

Each of the separate electrodes 8*bc*, 8*de*, . . . is disposed on the side and bottom surfaces of the ink channels 1*bc*, 1*de*, . . . , whereas the branches of the common electrode 9*ab*, 9*cd*, . . . are disposed on the side and bottom surfaces of the dummy channels 2*ab*, 2*cd*, . . . . The common electrode and the separate electrodes are covered by a protective film 14, whereby the separate electrodes are not in direct contact with the liquid ink. The piezoelectric side walls 3*a*, 3*b*, . . . are polarized in the direction shown by arrows P, each of which is directed from an ink channel to an adjacent dummy channel. Moreover, the top plate 4 has a slit 13 above each dummy channel 2*ab*, 2*cd*, . . . , whereby the top plate 4 is partially separated by the slit 13.

In the configuration of the ink jet recording head of the present embodiment, when an electric field is applied to each side wall in the direction of arrow P by applying a voltage between the separate electrode and the common electrode, the side wall expands in the direction P so that volume of the corresponding ink channel is reduced to eject the liquid ink therefrom by a pressure.

By the configurations that each of the dummy channels has a larger depth (Hd) than the depth (Hi) of the ink channels and that the top cover plate has a slit for each of the dummy channels, as described above, the cross-talk can be reduced in the ink jet recording head of the present embodiment.

The term "cross-talk" as used herein means that the speed and the size of the ink droplet ejected from a specified ink channel depend on the number of ink channels which are concurrently driven by a driving pulse. The reason for the reduction of the cross-talk by the latter configuration is considered due to the fact that the transformation of the sidewall of the driven ink channel is constrained by the bottom of the sidewall, as will be detailed later. If the dummy channel has a depth equal to or smaller than the depth of the ink channel, a sliding transformation generated in the bottom of the dummy channel causes transformation in the side wall of the adjacent ink channel. On the other hand, in the configuration wherein the dummy channel has a larger depth, since the bottom of the dummy channel is located below the bottom of the ink channel, a transformation is not transferred through the bottom of the dummy channel and cross-talk between the ink channels is reduced. In the former configuration, the slit formed in the top plate also prevents transfer of the transformation between adjacent ink channels, thereby further reducing the cross-talk therebetween.

Referring to FIGS. 4A to 4D, operation of the ink jet recording head of the present embodiment will be described in the case that a specified ink channel 1*bc* is driven for ink ejection.

Figure 4A:
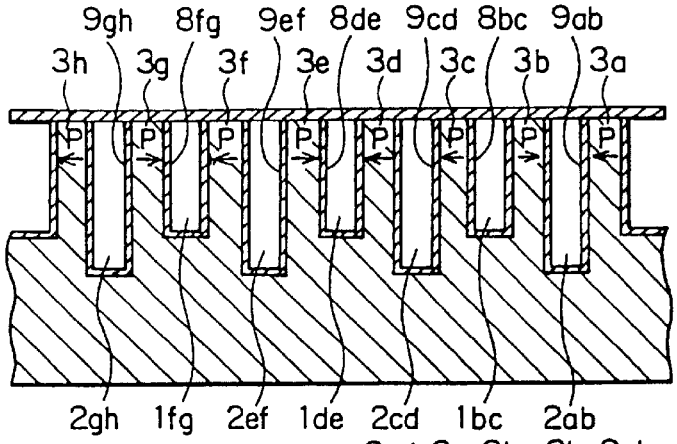
FIGS. 4A to 4D are cross-sectional views of the ink jet recording head of FIG. 2 in consecutive steps of operation, for showing the function of the ink jet recording head of the present embodiment.
Figure 4B:
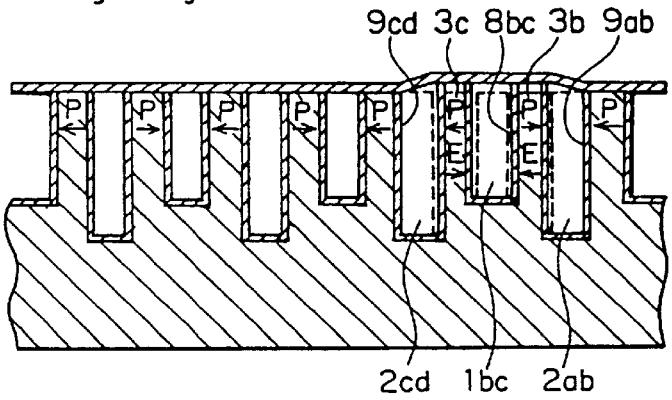

FIG. 4A shows a stationary state before driving the ink channel 1*bc*. To drive the ink channel 1*bc*, the side walls 3*b* and 3*c* are driven by using the piezoelectric effect. First, an electric field E is applied in the side walls 3*b* and 3*c* so that the electric field E is directed opposite to the direction of the polarization P, as shown in FIG. 4B. As a result, the side walls 3*b* and 3*c* reduce their widths (parallel to the polarization P) and increase their height (perpendicular to the polarization P), thereby increasing the volume of the specified ink channel 1*bc*, as shown in FIG. 4B. The increase of the volume allows the liquid ink to flow from the ink pool into the ink channel lbc in an amount corresponding to the amount of the volume increase.

Figure 4C:
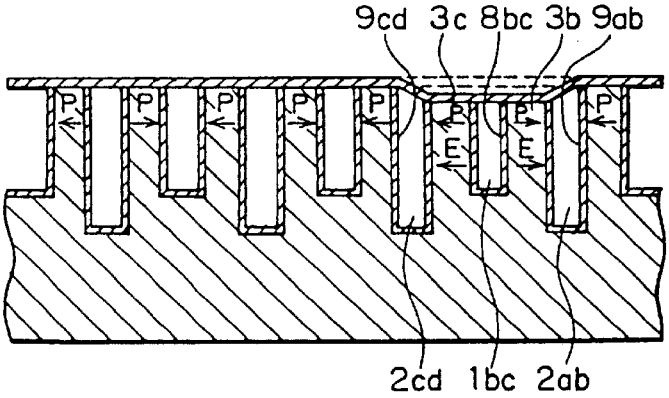
Figure 4D:
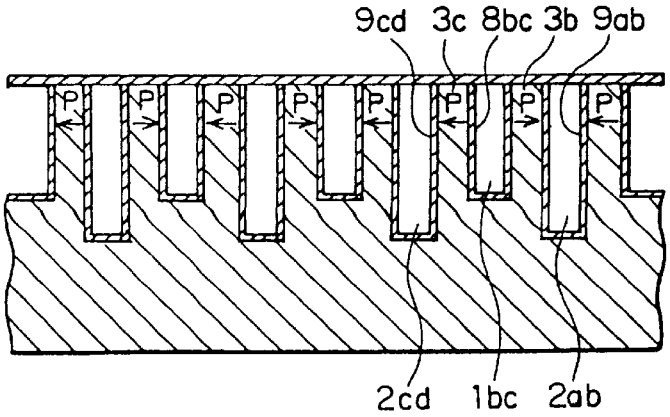

Subsequently, another electric field E is applied in the direction same as the direction of the polarization P in the side walls 3*b* and 3*c*. As a result, the side walls increase their widths and decrease their heights, as shown in FIG. 4C, thereby decreasing the volume of the ink channel 1*bc*. The volume decrease allows the liquid ink in the ink channel 1*bc* to be ejected through the ink nozzle 6*bc*. It is to be noted that the step shown in FIG. 4B controls the location of the ink meniscus formed around the nozzle for the ink channel 1*bc*, although the step shown in FIG. 4C following the step shown in FIG. 4A without the step shown in FIG. 4B also achieves ink ejection. Then, the electric field E is stopped or made zero, which causes an increase of the volume in the ink channel 1*bc* to introduce the liquid ink from the ink pool in an amount corresponding to the amount of the volume increase. In this configuration, the ink supply from the ink pool to the ink channel 1*bc* is effected twice in the steps shown in FIG. 4B and FIG. 4D, which provides a stable ink ejection by stabilizing a frequency response of the speed or size of the ink droplets.

In the above operation, the depth of the dummy channel with respect to the depth of the ink channel affects the cross-talk, as described before, which is detailed hereinafter.

Figure 5:
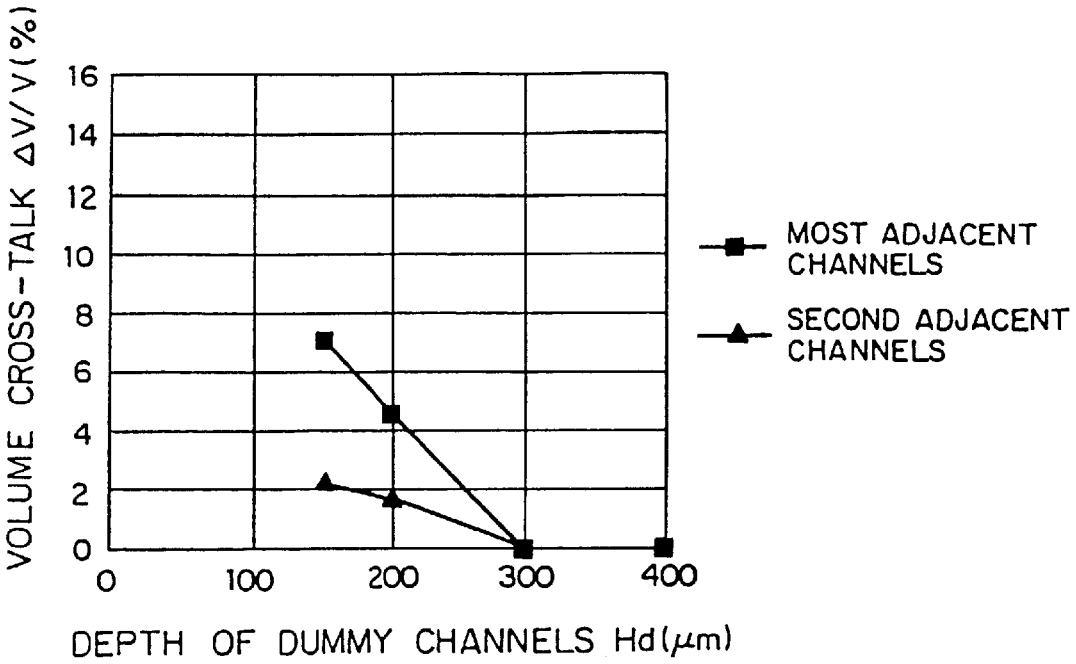
FIG. 5 is a graph showing volume cross-talk plotted against the depth of the dummy channel for showing the function in the first embodiment.
Figure 6:
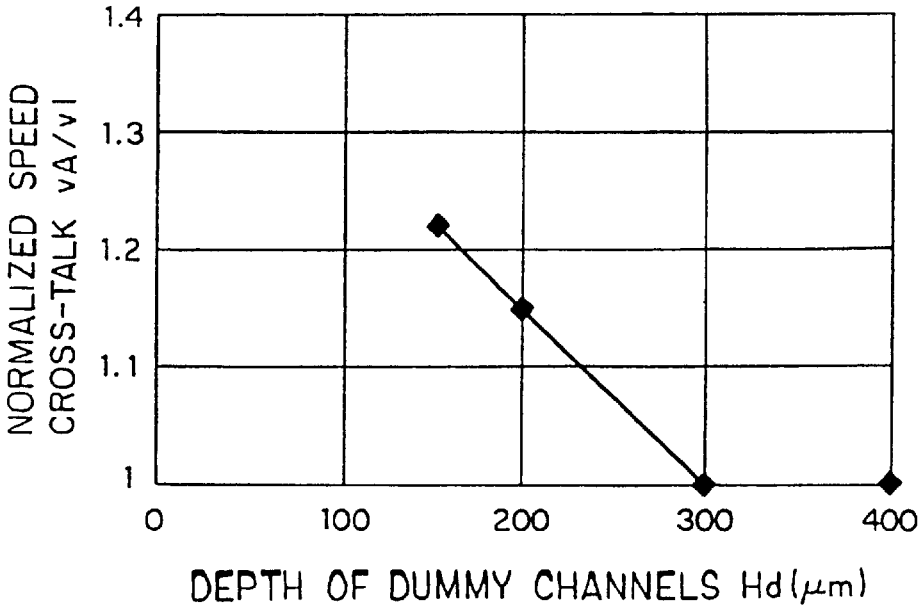
FIG. 6 is a graph showing speed of droplet against the depth of the dummy channel for showing the function in the first embodiment.

Referring to FIGS. 5 and 6, there are shown calculated volume cross-talk (%) between the adjacent ink channels and normalized speed cross-talk of the ink droplet, respectively, in the ink jet recording head, which are plotted against the depths 150 $\mu$m, 200 $\mu$m, 300 $\mu$m and 400 $\mu$m of the dummy channels, with the depth of the ink channels fixed at 200 $\mu$m. The volume cross-talk between the specified ink channel and the ink channel disposed next to the adjacent ink channel (second adjacent channel) is also plotted in the graph.

The volume cross-talk is expressed in terms of $\Delta V/V$ wherein V is the volume of the adjacent ink channel not driven and AV is the volume change of the adjacent ink channel caused by the driving of the specified ink channel. The normalized speed cross-talk is expressed in terms vA/v1 wherein vA and v1 are the speeds of the ink droplet from the specified ink channel in the case of a single-channel driving and in the case of an all-channel driving, respectively.

As understood from FIG. 5, a larger depth of the dummy channel provides smaller volume cross-talk, and a depth equal to or above 300 $\mu$m substantially eliminates the volume crosstalk. Similarly, as understood from FIG. 6, a larger depth of the dummy channel provides a smaller normalized speed cross-talk of the ink droplet, and a depth equal to or above 300 $\mu$m provides a normalized speed cross-talk substantially equal to 1, which is in correlation to the volume cross-talk.

Referring to FIGS. 7A to 7D, there are shown the results of structural analysis of the profile of the ink jet recording head by using a finite element method for the cases of the depths 150 $\mu$m, 200 $\mu$m, 300 $\mu$pm and 400 $\mu$m, respectively, of the dummy channel, with the ink channel fixed at 200 $\mu$m.

Figure 7A:
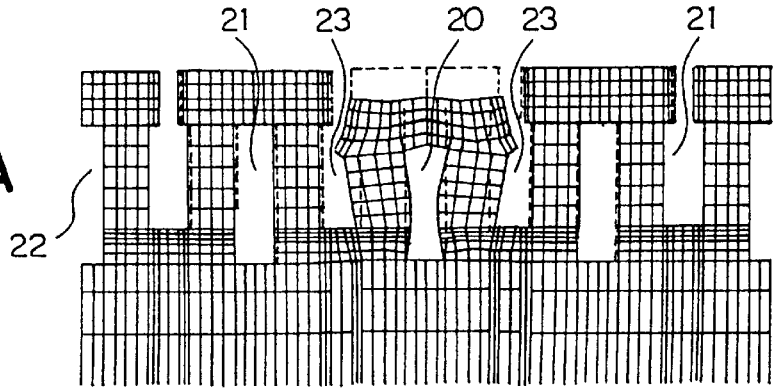
FIGS. 7A to 7D are schematic diagrams of the profiles of the channels in ink jet recording heads for showing depth dependency of the volume cross-talk.
Figure 7B:
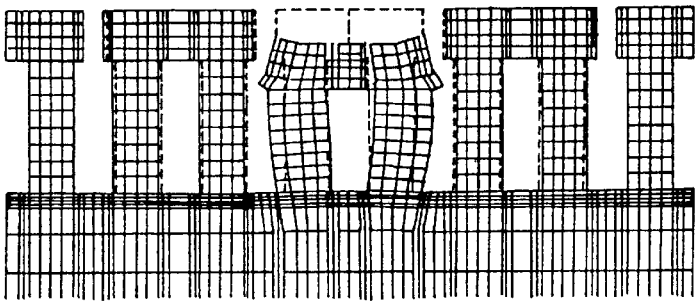
Figure 7C:
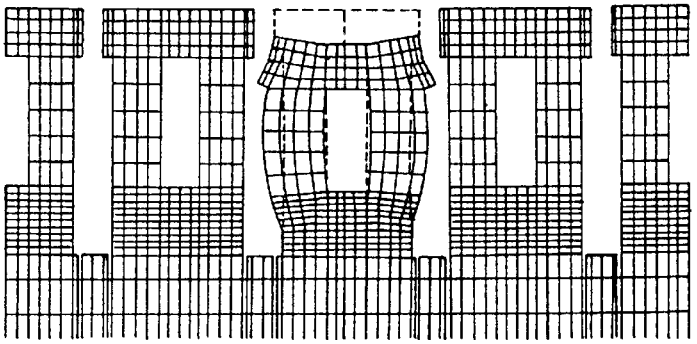
Figure 7D:
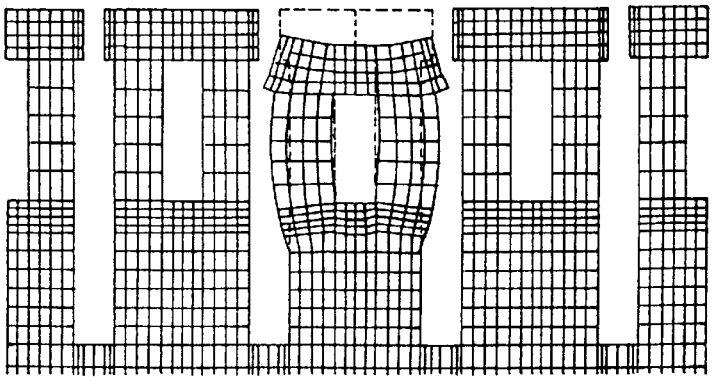

As will be understood from FIGS. 7A and 7B showing the case of Hd≦Hi, a slide transformation is generated at the bottom of the dummy channel 23 adjacent to the specified ink channel 20, and plays a major role in the cross-talk between the adjacent ink channels. On the other hand, in the case of Hd>Hi, as will be understood from FIGS. 7C and 7D, the sliding transformation does not substantially take place in the bottom of the adjacent dummy channel, which improves the problem crosstalk.

Figure 8A:
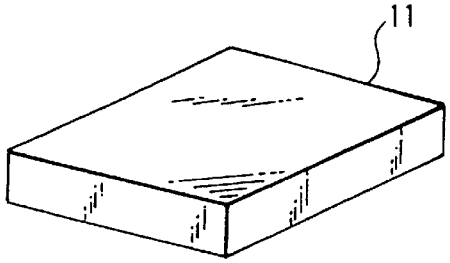
FIGS. 8A to 8H are perspective views of the ink jet recording head of FIG. 2 in consecutive steps of fabrication thereof.
Figure 8B:
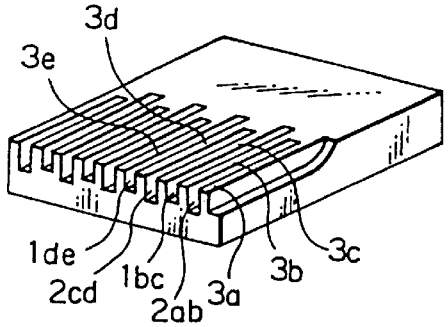

FIGS. 8A to 8H consecutively show steps of fabricating the ink jet recording head of FIG. 2. In FIG. 8A, a piezoelectric planar substrate 11 is prepared from three-component (or tertiary) soft ceramics wherein composite oxides of a perovskite structure is added to PZT. The piezoelectric substrate 11 is subjected to a mechanical grinding as by a dicing saw to form a plurality of ink channels and a plurality of dummy channels which are arranged alternately with each other, as shown in FIG. 8B. In this step, the depth of the dummy channels 2*ab*, 2*cd*, . . . is made larger than the depth of the ink channels 1*bc*, 1*de*, . . . , whereas the length of the ink channels is made larger than the length of the dummy channels. Further, the rear end of the bottom of each of the ink channels which is to be located below the ink pool is made to have a curvature.

Figure 8C:
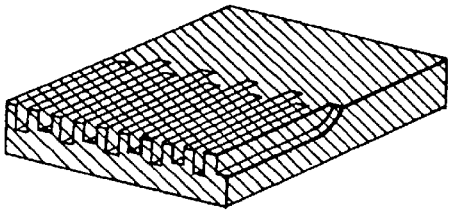
Figure 8D:
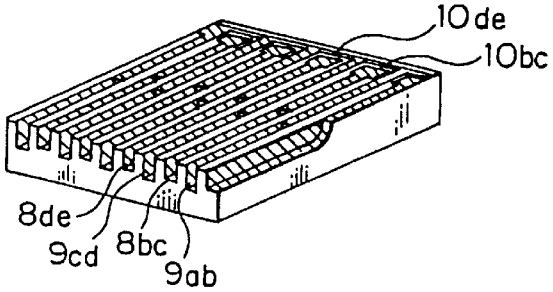

Subsequently, an Al electrode layer is formed by a sputtering technique over the entire surface of the substrate 11 including the inner surface of the channels, as shown in FIG. 8C, followed by patterning thereof to form branches 9*ab*, 9*cd*, . . . of a common electrode in the dummy channel, separate electrodes 8*bc*, 8*de*, . . . in the ink channel, and bonding pads 10*bc*, 10*de*, . . . on the main surface of the substrate, as shown in FIG. 8D. Material for the electrodes may be otherwise selected from Al alloys such as Al—Cu, Al—Si, Al—Si—Cu instead of Al, which may be formed on the substrate by chemical vapor deposition (CVD) instead of sputtering.

Thereafter, a protective SiO2 film not shown in the drawing is deposited by CVD to cover the entire surfaces of the electrodes except for the bonding pads 10*bc*. 10*de*, . . . . Material for the protective film may be selected from silicon nitride, borophosphosilicate glass, and polymer instead of SiO2, and the protective film may be formed by sputtering or dipping instead of CVD.

Figure 8E:
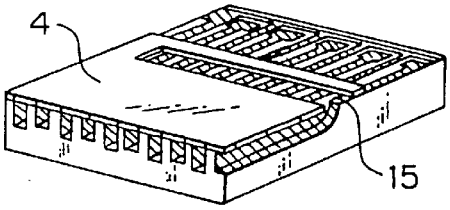
Figure 8F:
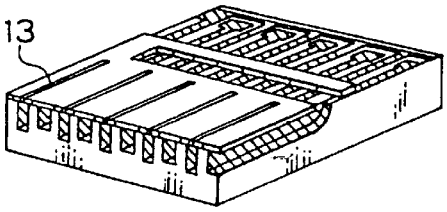
Figure 8G:
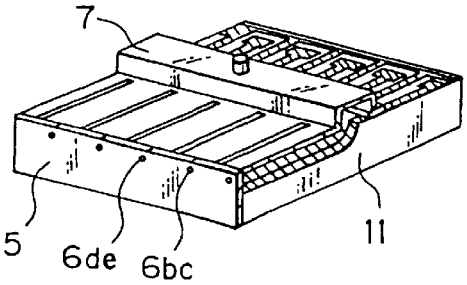
Figure 8H:
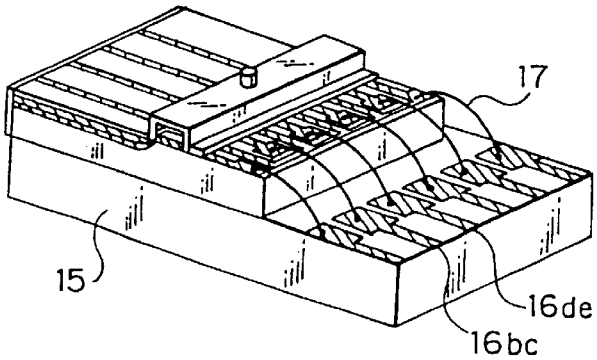

A polyimide top plate 4 is then bonded to the substrate, as shown in FIG. 8E, so that dummy channels 2*ab* and 2*cd* are completely covered and that the ink channel 1*bc*, 1*de* are communicated to the ink pool at the rear end of each ink channel. Thereafter, a U-shaped trough 7 is bonded to the top plate and the substrate by using an epoxy-resin based adhesive.

A polyimide nozzle plate 5 having a nozzle 6*bc*, 6*de*, . . . for each of the ink channels is then bonded to the front end of the substrate 11 so that each nozzle is communicated to a corresponding ink channel. Material for the top plate 4 maybe selected from ceramics, glass and silicon having a high rigidity, on which a thermoplastic resin adhesive and a thermosetting resin adhesive are applied on both the surfaces, respectively. Material for the nozzle plate 5 may be selected from a nickel or stainless steel plate on which a thermoplastic resin adhesive and a thermosetting plastic resin adhesive are applied on both the surfaces, respectively.

Subsequently, the bottom of the resultant piezoelectric substrate 11 is bonded onto a printed circuit board 15 having a plurality of lead terminals 16*bc*, 16*de*, . . . for supplying driving pulses. The bonding pads and the lead terminals are electrically connected by using bonding wires 7 made of gold, for example.

Figure 9:
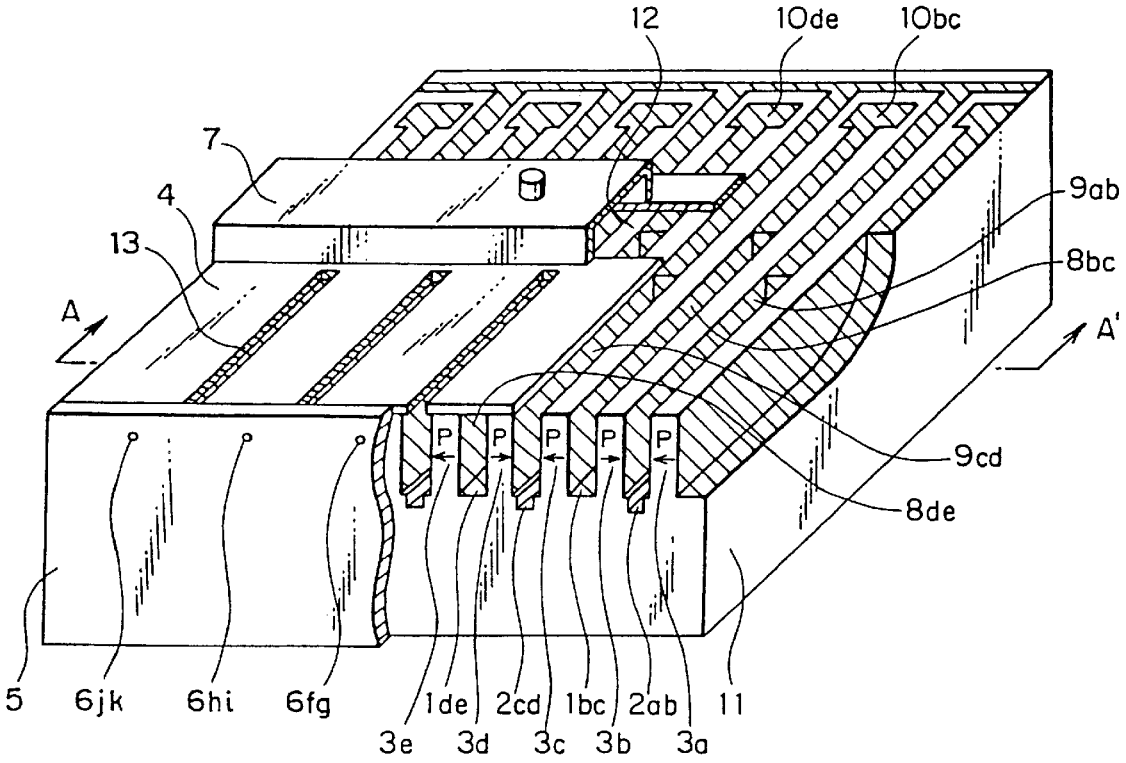
FIG. 9 is a perspective view of an ink jet recording head according to a second embodiment of the present invention.

Referring to FIG. 9, an ink jet recording head according to a second embodiment of the present invention has a configuration similar to the first embodiment except for the structure of the dummy channels. Specifically, the grinding step for the channels is first effected to have the same depth for the ink channels 1*bc*, 1*de*, . . . and the dummy channels 2*ab*, 2*cd*, . . . , and then effected only to the dummy channels 2*ab*, 2*cd*, . . . , after the top plate 5 is bonded to the substrate 11, together with the step of forming slits 13 in the top plate 5.

Figure 10A:
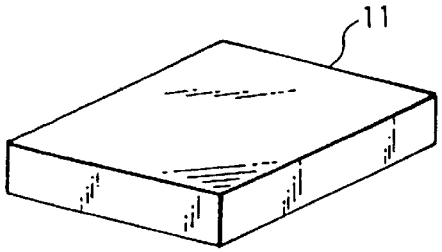
FIGS. 10A to 10H are perspective views of the ink jet recording head of FIG. 9 in consecutive steps of fabrication thereof.
Figure 10B:
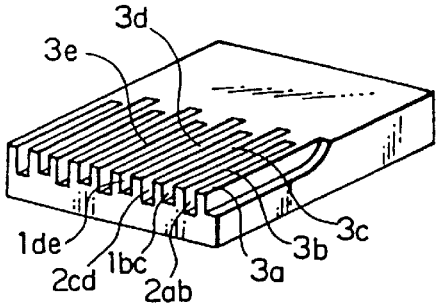
Figure 10C:
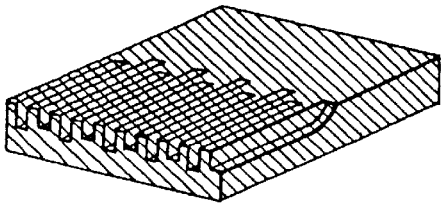
Figure 10D:
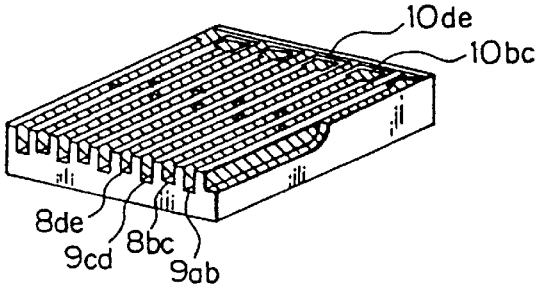
Figure 10E:
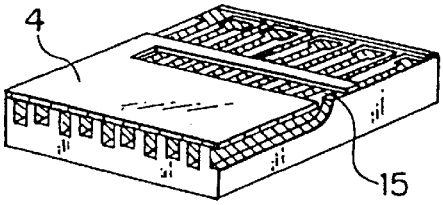
Figure 10F:
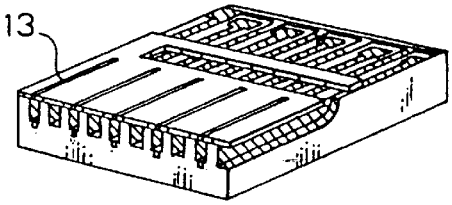
Figure 10G:
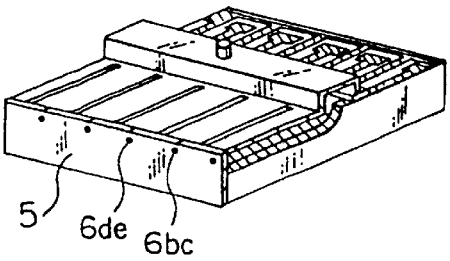
Figure 10H:
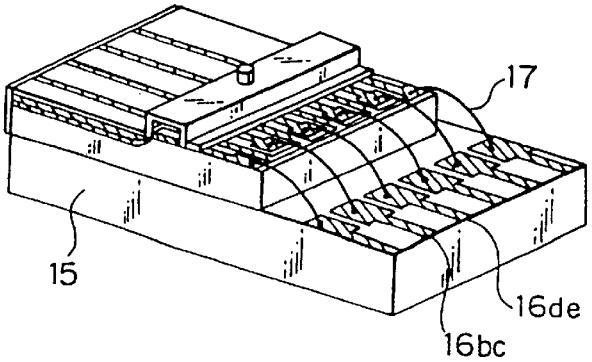

Referring to FIGS. 10A to 10H showing fabrication steps of the second embodiment similarly to FIGS. 8A to 8H, the grinding step shown in FIG. 10B is effected to have the same depth for the ink channels 1*ab*, 1*cd*, and the dummy channels 2*bc*, 2*de*, . . . . In step shown in FIG. 10E, the top plate 4 has no slit therein, and in step shown in FIG. 10F, slits 13 and the bottom of the dummy channels are formed by grinding using a dicing saw. Other steps are similar to those shown in FIGS. 8A to 8H.

By the configuration of the second embodiment, the bottom portions of the dummy channels are not provided with the branch of the common electrode, which does not affect the function of the ink jet recording head, however. Further, the depth of the dummy channel is made smaller at the portion other than the portion corresponding to the slit 13 of the top plate 4. Accordingly, the rigidity of the substrate is improved compared to the first embodiment while effectively intercepting the transfer of the transformation of the side wall.

Figure 11:
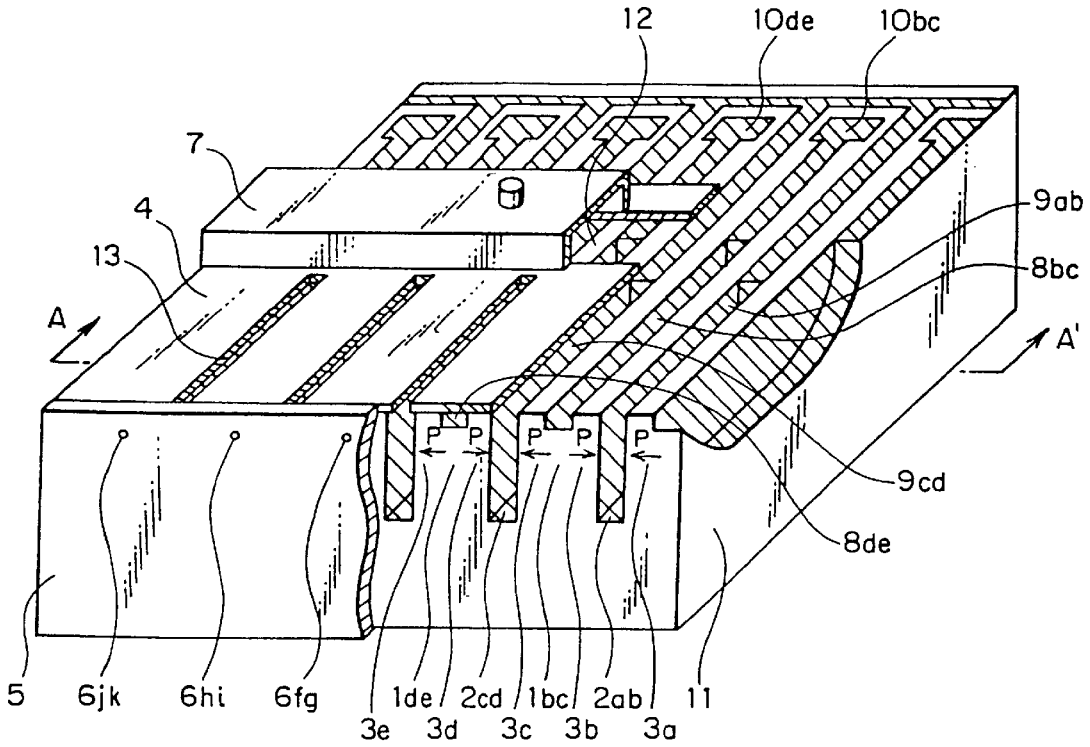
FIG. 11 is a perspective view of an ink jet recording head according to a third embodiment of the present invention.

Referring to FIG. 11, an ink jet recording head according to a third embodiment of the present invention is similar to the first embodiment except that the bottom of each of the ink channels has a curvature along the entire length of the ink channel. A portion of the curvature may be replaced by an inclination rising toward the rear end of the ink channel. The configuration of the third embodiment provides the advantage in that air bubbles introduced in the liquid ink do not trapped in the ink channel 1*bc*, 1*de*, . . . to be ejected from the ink channels, thereby improving the flow of the liquid ink to stabilize the ink ejection.

Figure 12:
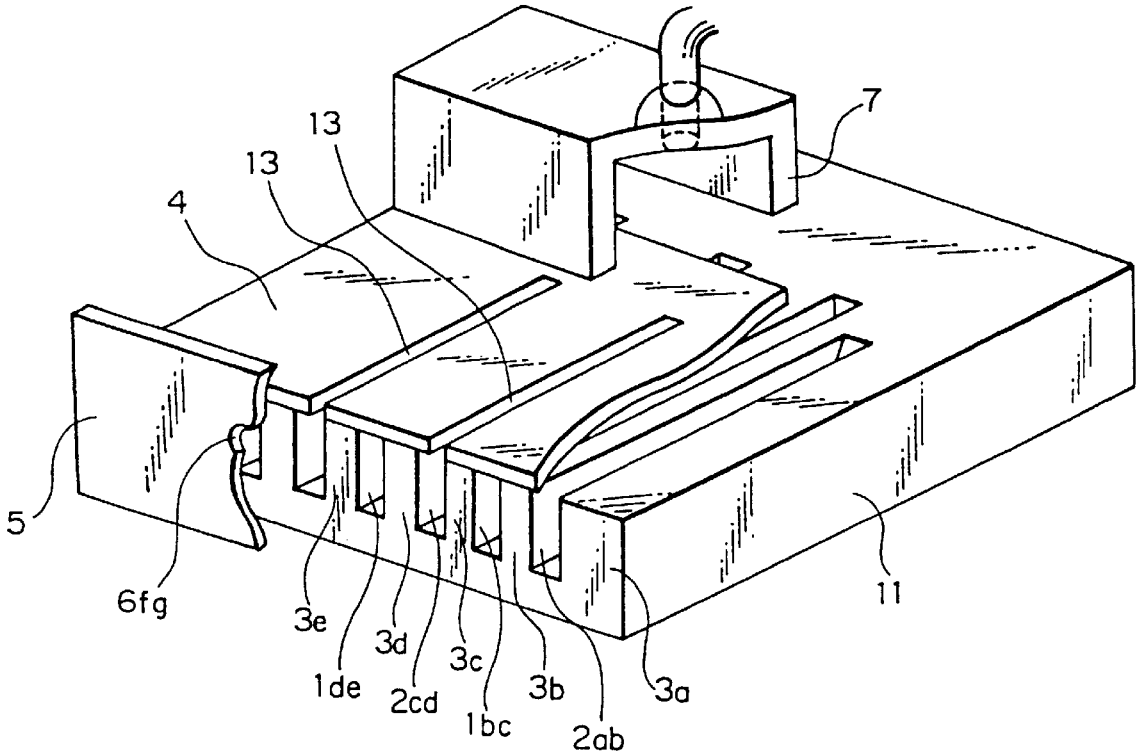
FIG. 12 is a perspective view of an ink jet recording head according to a fourth embodiment of the present invention.

Referring to FIG. 12, an ink jet recording head according to a fourth embodiment of the present invention is similar to the first embodiment except for the configuration of the dummy channels 2*ab*, 2*cd*, . . . which have the same depth as the ink channel 1*bc*, 1*de*, . . . , and the configuration of the ink channels 1*bc*, 1*de*, . . . which have respective rear ends having normal edges. In FIG. 12, electrodes are not shown for clearly depicting the profile of the channels. In this embodiment, the cross-talk is reduced only by the slits 13 of the top plate 4, which intercept the transformation, and thus the cross-talk, between adjacent ink channels.

Figure 13:
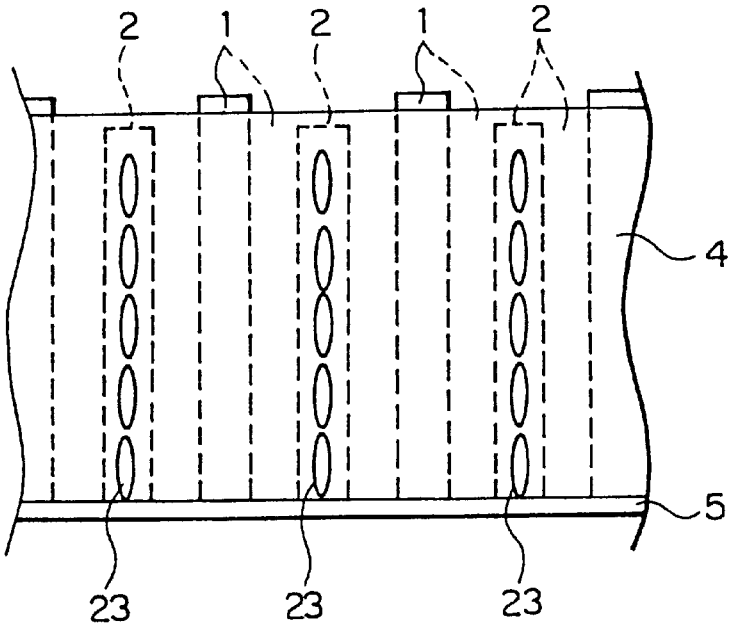
FIGS. 13 and 14 are modifications of the top plate shown in FIG. 12.
Figure 14:
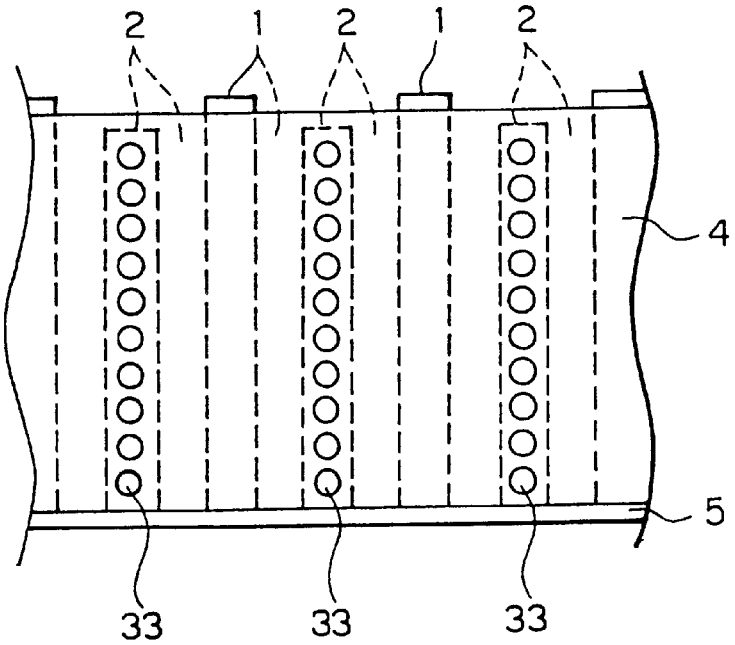

Referring to FIG. 13 showing a top plate in a modification of the ink jet recording head of FIG. 12, the top plate 4 has therein a row of elliptical holes 23 for each of the dummy channels 2 instead of the slits 13 shown in FIG. 12. Referring to FIG. 14 showing another top plate in another modification of the ink jet recording head of FIG. 12, the top plate 4 has a row of round holes 33 instead of slits. The discontinuous slits or cut-outs of the top plate 4 also intercept the transfer of the transformation of the stress between adjacent ink channels.

Since the above embodiments are described only for examples, the present invention is not limited to the above embodiments and various modifications or alterations can be easily made therefrom by those skilled in the art without departing from the scope of the present invention.

What is claimed is:

1. An ink jet recording head comprising a piezoelectric substrate having a plurality of ink channels for receiving liquid ink therein and a plurality of dummy channels extending parallel to one another and to said ink channels on a main surface of said substrate, said ink channels and said dummy channels being arranged alternately on said piezoelectric substrate, a plurality of separate electrodes disposed in respective said ink channels, a common electrode disposed in said dummy channels, a top plate fixed to the main surface of said piezoelectric substrate for covering said ink channels and said dummy channels, a nozzleplate disposed at a front surface of said piezoelectric substrate for defining front ends of said channels and having a nozzle for each of said ink channels for ejection of liquid ink therefrom, said dummy channels having a depth larger than a depth of said ink channels.

2. An ink jet recording head as defined in claim 1, wherein each of said ink channels comprises an ink inlet port at a rear end of said ink channel, and the rear end of said ink channel has a curvature.

3. An ink jet recording head as defined in claim 2, wherein each of said ink channels has an inclination at a bottom thereof rising toward the rear end thereof.

4. An ink jet recording head as defined in claim 1, wherein said top plate has a slit corresponding to each of said dummy channels and said slit has an open-end at the nozzle plate.

5. An ink jet recording head as defined in claim 1, wherein said slit is composed of a row of holes.

6. An ink jet recording head comprising a piezoelectric in a monolithic structure having a plurality of ink channels for receiving therein liquid ink and a plurality of dummy channels extending parallel to one another and to said ink channels on a main surface of said piezoelectric substrate, said ink channels and said dummy channels being arranged alternately on said piezoelectric substrate, a plurality of separate electrodes disposed in respective said ink channels, a common electrode disposed in said dummy channels, a top plate disposed on the main surface of said piezoelectric substrate for covering said ink channels and said dummy channels, a nozzle plate disposed at a front surface of said substrate for defining front ends of said channels and having a nozzle for each of said ink channels for ejection of liquid ink therefrom, said top plate having a slit corresponding to each of said dummy channels.

7. An ink jet recording head as defined in claim 6, wherein each of said ink channels has an ink inlet port having a curvature at a rear end of said ink channel.

8. An ink jet recording head as defined in claim 6, wherein each of said ink channels has an inclination at a bottom thereof rising toward the rear end of said ink channel.

9. An ink jet recording head as defined in claim 6, wherein said slit is composed of a row of holes formed in said top plate.

* * * * *